US006226826B1

(12) United States Patent
Rice et al.

(10) Patent No.: US 6,226,826 B1
(45) **Date of Patent: *May 8, 2001**

(54) BUMPER ASSEMBLIES FOR SWIMMING POOL CLEANERS

(75) Inventors: Chris A. Rice; Mark J. Bauckman, both of Boca Raton; Michael J. Gregg, Plantation, all of FL (US)

(73) Assignee: Zodiac Pool Care, Inc., Fort Lauderdale, FL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/244,737

(22) Filed: Feb. 5, 1999

(51) Int. Cl.[7] ..... E04H 4/16

(52) U.S. Cl. ..... 15/1.7; 15/246; 114/219; 210/169

(58) Field of Search ..... 15/1.7, 246, 325; 114/219, 222; 210/169

(56) References Cited

U.S. PATENT DOCUMENTS

| | | | |
|---|---|---|---|
| 2,330,684 | | 9/1943 Colling . | |
| 4,152,802 | | 5/1979 Chauvier . | |
| 4,156,948 | | 6/1979 Chauvier . | |
| 4,463,468 | | 8/1984 Chauvier . | |
| 4,642,833 | | 2/1987 Stoltz et al. . | |
| 4,742,593 | | 5/1988 Kallenbach . | |
| 4,761,848 | | 8/1988 Hofmann . | |
| 5,014,382 | | 5/1991 Kallenbach . | |
| 5,398,362 | | 3/1995 Chauvier . | |
| 5,655,246 | * | 8/1997 Chang | 15/1.7 |
| 6,049,933 | * | 4/2000 McLaughlin | 15/1.7 |

FOREIGN PATENT DOCUMENTS

| | | |
|---|---|---|
| 0721033 | 7/1996 | (EP) . |
| 0745744 | 12/1996 | (EP) . |
| 2005993 | 5/1979 | (GB) . |

* cited by examiner

*Primary Examiner*—Robert J. Warden, Sr.
*Assistant Examiner*—Kaj K. Olsen
(74) *Attorney, Agent, or Firm*—Dean W. Russell; Kilpatrick Stockton LLP

(57) ABSTRACT

Bumpers and assemblies for swimming pool cleaners are disclosed. Such assemblies may include contoured frames to which flexible fins are attached to facilitate deflection of cleaners when obstacles are encountered. Side wings connecting the frame to the body of a cleaner may additionally be employed as part of the assemblies, as may a weight moveable about two axes. In use, the side wings both promote cleaner deflection and reduce body wear that otherwise would occur. The non-stationary weight permits continuous rebalancing of the cleaner depending on its location and orientation within a pool. An optional lower bumper facilitates operation of the cleaner by reducing the likelihood of its becoming trapped against objects such as steps located within swimming pools.

9 Claims, 9 Drawing Sheets

BUMPER ASSEMBLIES FOR SWIMMING POOL CLEANERS

FIELD OF THE INVENTION

This invention relates to (automatic) swimming pool cleaners and in particular to bumpers for and other components of such cleaners.

BACKGROUND OF THE INVENTION

A variety of devices exist that move automatically over surfaces of swimming pools to be cleaned. One such pool cleaner operates in cooperation with the reduced pressure caused by a pump to induce debris-laden fluid within a pool to flow through the cleaner (and other filtration equipment if desired). The cleaner functions by causing a valve, or diaphragm, to oscillate, periodically interrupting the fluid flow through the cleaner. This periodic interruption in turn causes movement of the device over the surface to be cleaned. Exemplary cleaners of this type are disclosed in U.S. Pat. Nos. 4,642,833 and 4,742,593, which patents are incorporated herein in their entireties by this reference.

U.S. Pat. No. 5,014,382 ("the Kallenbach patent"), also incorporated herein in its entirety by reference, discloses another fluid-interruption version of an automatic swimming pool cleaner. Illustrated in the Kallenbach patent as being attached to the cleaner are a bumper and a retainer that includes a weight. The retainer, which is integrally formed with a portion of the body of the cleaner, thereby fixes the position of the weight relative to the body. Moreover, rigid plastic is used to form the bumpers of commercially-available cleaners made according to the Kallenbach patent. As noted in the Kallenbach patent (col. 3, line 65 through col. 4, line 3), the bumper, when it contacts an obstruction, assists in lifting the flexible disc of a cleaner > from the surface and thus breaking the pressure holding the disc . . . to the surface being traversed. This allows the cleaner . . . to move freely until it disengages from the obstruction.

SUMMARY OF THE INVENTION

The present invention, by contrast, provides alternative bumper assemblies for swimming pool cleaners. Unlike the bumper of the Kallenbach patent, for example, that of the present invention may include a flexible edge, or fin, attached to the main frame of the bumper. The fin and contour of the main frame facilitate deflection of the associated cleaner when obstacles are encountered. They also aid in the cleaner transitioning from traversing the bottom of the pool to cleaning its sides. The ability of the cleaner to climb steps sometimes found in pools additionally is enhanced by the shape of the frame.

Further features of the present invention include side wings connecting the frame to the body of the cleaner. These wings too may have flexible leading edges to promote deflection of the cleaner when obstacles (particularly steps and ladders) are encountered. The side wings, as well as the frame, also reduce cleaner body wear that otherwise would occur from frictional contact with the walls of and obstacles placed within swimming pools.

Unlike the cleaners of the Kallenbach patent, moreover; those of the present invention include a mobile—rather than stationary—weight. The weight, in some embodiments positioned about a tapered section of the main frame of the bumper assembly, is adapted to slide, or move, in two axes: longitudinally along the length of the section and laterally across its (tapered) width. Such movement occurs automatically as the cleaner operates, effectively continuously rebalancing it depending on its location and orientation within the pool. The action of the weight can also result in increased pool coverage per unit time by the cleaner.

Additionally optionally included in cleaners of the present invention is another, "belly" weight as well as a lower bumper assembly. Positioned above and adjacent the flexible disc, the lower bumper facilitates operation of a cleaner by reducing the likelihood of the cleaner becoming trapped against an object such as a step located within a swimming pool. More or less horizontal when the cleaner is upright and generally parallel to the disc, the lower bumper forms the leading edge of the bottom of the cleaner body when the cleaner approaches an object other than perpendicularly. It thus is able to function as a sacrificial member, itself wearing by contact with objects rather than permitting the cleaner body to do so.

In some embodiments of the invention, the lower bumper may be comprised of two sections, the sections being integrally or otherwise connected at one, "first" end and connectable at the other, "second" end of each. The first end may effectively function as a hinge, permitting expansion of the interior of the bumper to allow it to be placed about the exterior of a cleaner body. Once so placed, the second ends of the sections may be brought into contact and latched, or connected, in position. The lower bumper additionally may attach to the main frame of the finned bumper at one or more locations, utilizing protrusions fitted into (and, if desired, interlocking with) corresponding bosses or collars included as part of the main frame.

It is therefore an object of the present invention to provide bumpers or bumper assemblies for an automatic swimming pool cleaner.

It is also an object of the present invention to provide bumper assemblies adapted to facilitate deflection of the cleaner when obstacles are encountered in use.

It is another object of the present invention to provide bumper assemblies in which such deflection is facilitated by a flexible fin, which in at least some embodiments is attached to a rigid, contoured frame.

It is a further object of the present invention to provide side wings, or similar wear-preventing structures, connecting the frame to the body of the cleaner.

It is yet another object of the present invention to provide a system, repositionable in use, for balancing the cleaner with which it is associated.

It is also an object of the present invention to provide such a system that includes a weight adapted to move along two axes.

It is an additional object of the present invention to provide such a system in which the action of the weight can result in increased pool coverage per unit time by the cleaner.

It is, moreover, an object of the present invention to provide bumpers positioned more or less parallel to flexible discs of cleaners and adjacent such discs.

It is furthermore an object of the present invention to provide a bumper comprised of two sections, the sections being effectively hinged at one end and connectable at the other.

Other objects, features, and advantages of the present invention will become apparent with reference to the remainder of the text and the drawings of this application.

DETAILED DESCRIPTION

Figure 1:
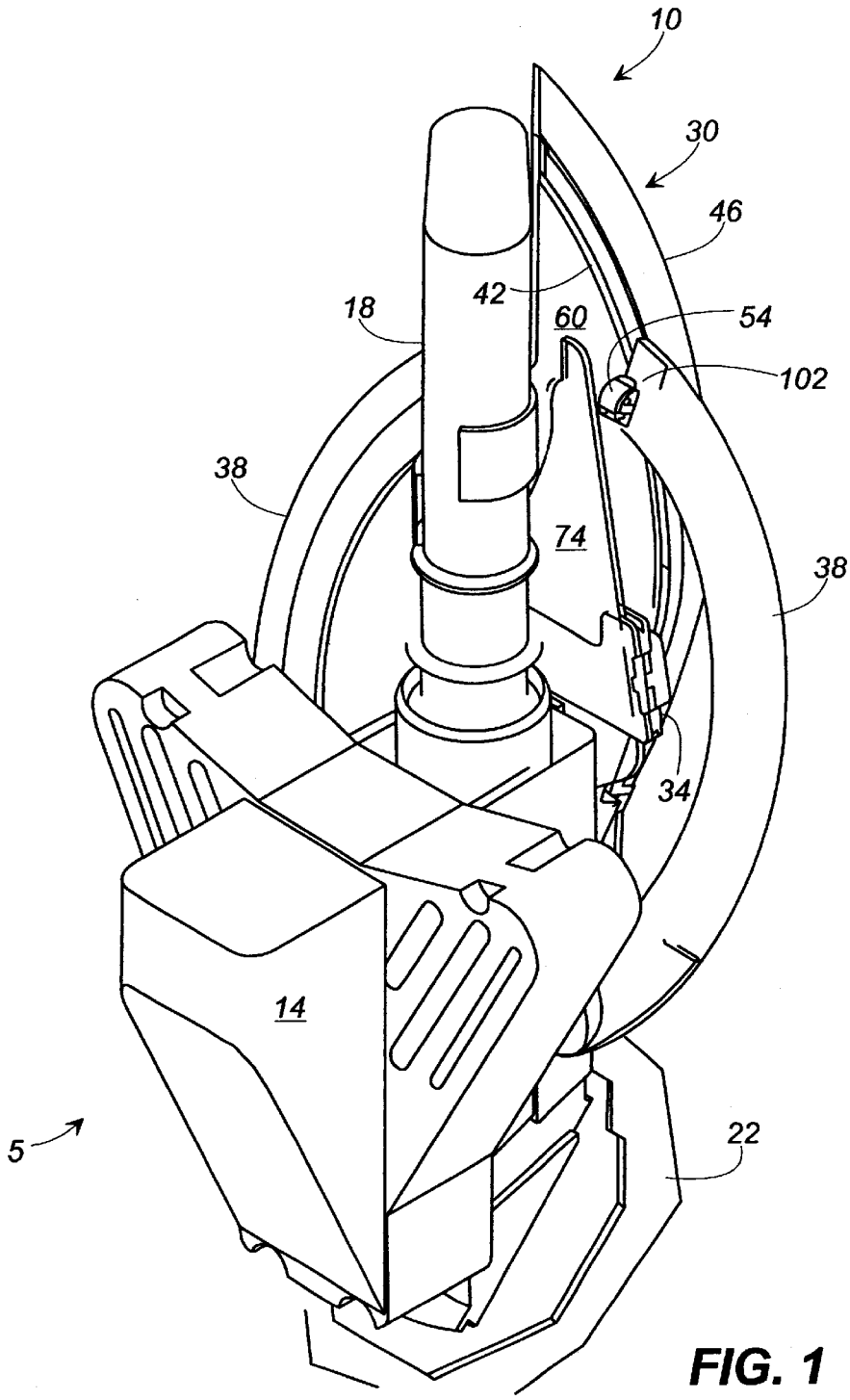
FIG. 1 is a perspective view of portions of a swimming pool cleaner containing a bumper assembly of the present invention.
Figure 2:
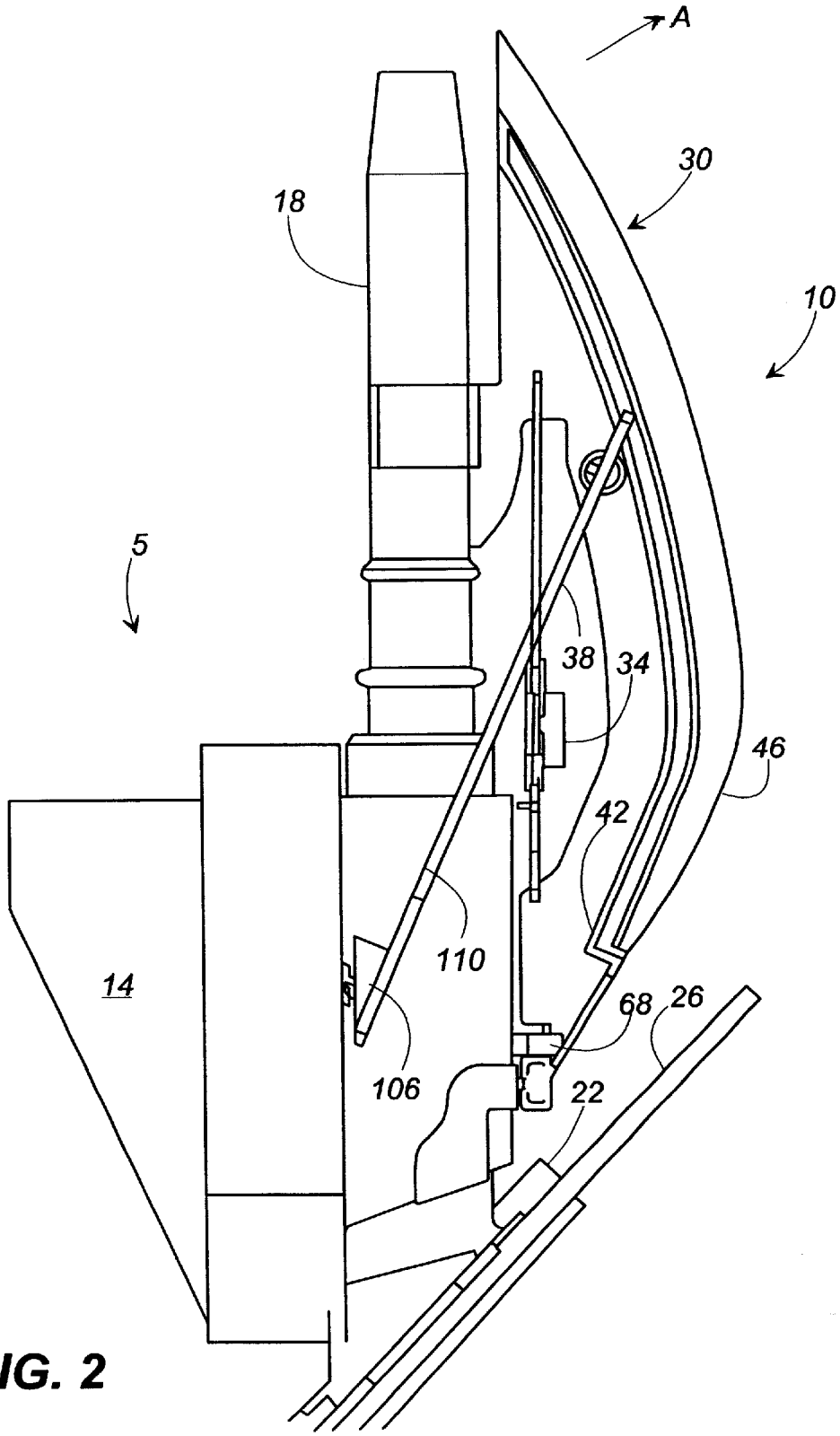
FIG. 2 is a side elevational view of the swimming pool cleaner of FIG. 1.

FIGS. 1–2 show an exemplary automatic swimming pool cleaner S to which bumper assembly 10 of the present invention is connected. As with many commercially-available pool cleaners, cleaner S includes a body 14 to which an extension pipe 18 is attached or formed. Also used as part of cleaner S are a footpad 22, shown in FIGS. 1–2, and a flexible disc 26. Cleaner S typically moves generally in the direction of arrow A when upright, thus often making bumper assembly 10 the leading edge of the cleaning device.

Figure 3:
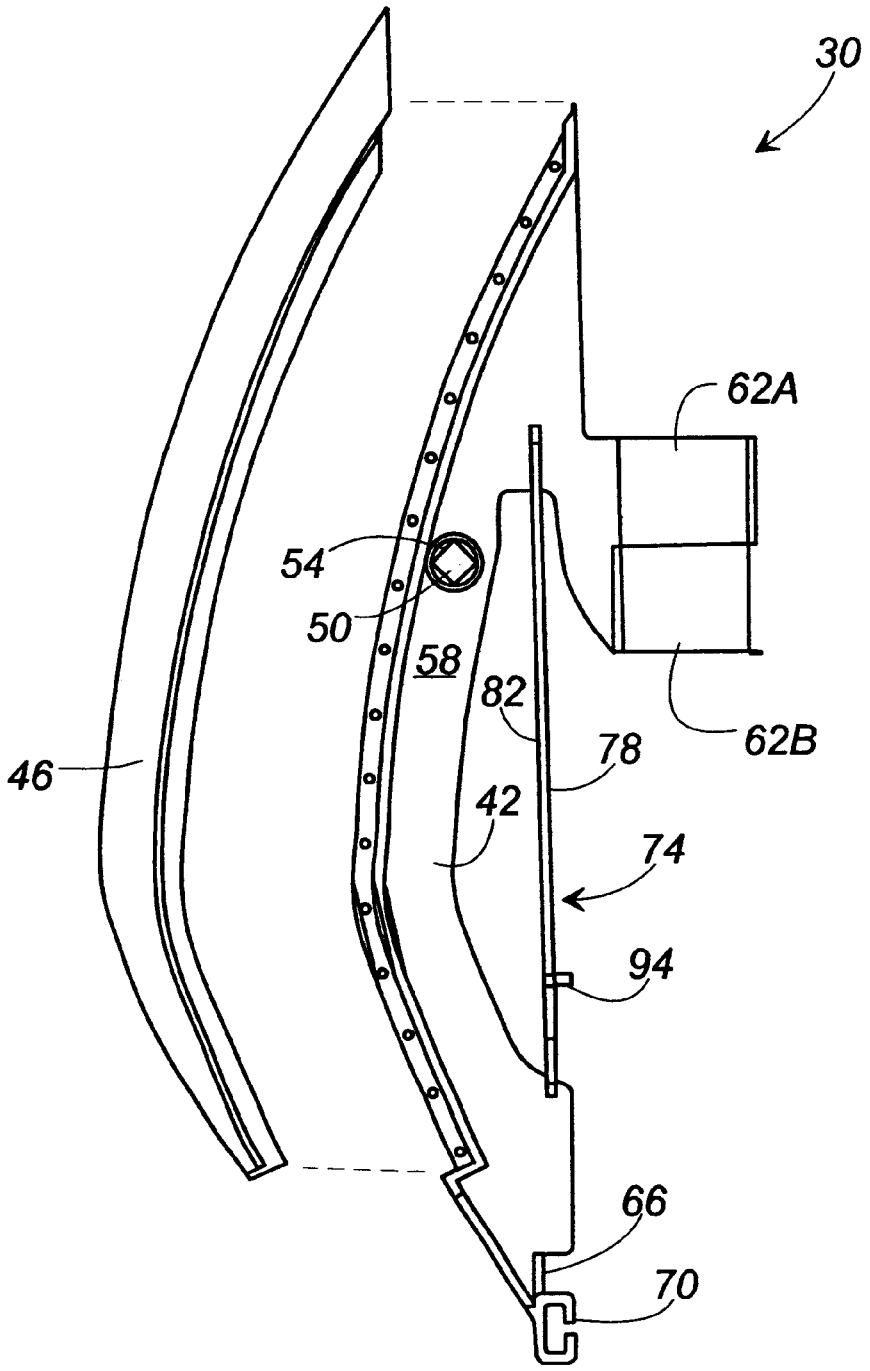
FIG. 3 is a partially-exploded side elevational view illustrating the main frame and fin of the bumper assembly of FIG. 1.

Included in embodiments of assembly 10 are bumper 30, weight assembly 34, and side wings 38. FIG. 3 illustrates bumper 30, which in the illustrated embodiment is oriented approximately forty-five degrees from the horizontal plane when body 14 is upright and comprises main frame 42 and fin 46. Frame 42 may be formed of plastic or other material that is substantially rigid, while fin 46 is normally composed of flexible material such as polyurethane (or any appropriate thermoplastic elastomer or rubber or other flexible material). Fin 46 is designed to attach to frame 42 in any suitable manner, including (although not exclusively) through use of a water-insoluble adhesive.

The flexibility and curvature of fin 46 facilitate deflection of cleaner S should it encounter certain obstacles in a pool. These characteristics of fin 46 additionally enhance the ability of cleaner S to climb any underground stairs in the pool, promoting cleaning of their otherwise relatively hard-to-access perpendicular surfaces. The contour of fin 46 further assists cleaner S in the transition from cleaning the bottom of a pool to cleaning one of its sides.

Frame 42 may include opening 50, in which collar 54 may be incorporated. Although not readily visible in FIG. 3, collar 54, when present, may protrude from both surface 58 of frame 42 and from its opposite (reverse) surface 60. Collar 54 is adapted to receive side wings 38, as described hereafter in greater detail; in its absence, such wings 38 may in some cases simply be received by opening 50.

Additionally contained as part of frame 42 are split collars 62A and 62B. Each semi-cylindrically shaped, split collars 62A and 62B connect frame 42 to (cylindrical) extension pipe 18 of cleaner S. The mechanical fit provided by split collars 62A and 62B retains them in place, thus fixing the position of frame 42 relative to extension pipe 18. In some embodiments of bumper assembly 10, split collars 62A and 62B are integrally formed with frame 42. This is not necessary, however, as water-insoluble adhesives or other connection media alternatively may be employed. Those skilled in the art will also recognize that other mechanisms for connecting the frame 42 to cleaner S may be used instead of split collars 62A and 62B and that neither collars 62A and 62B nor pipe 18 need necessarily be cylindrically shaped.

To brace the connection with cleaner S, frame 42 further may contain a recess or slot 66 into which a corresponding protrusion 68 extending from body 14 is fitted. If necessary or desired, a clip 70 may also be included as part of frame 42 for connection to body 14. Neither slot 66 nor clip 70 is required for satisfactory operation of bumper assembly 14, although having either or both may improve the deflection response of bumper 30 when it contacts an obstacle within a pool.

Additionally included as part of frame 42 is tapered section 74. Preferably (although not necessarily) integrally formed as part of frame 42, tapered section 74 provides surfaces 78 and 82 along which weight assembly 34 slides. Surfaces 78 and 82 are, in embodiments of the invention consistent with FIG. 3, perpendicular to surfaces 58 and 60 of frame 42. They need not be ninety degrees removed, however, nor must they be flat as illustrated in the figure.

Figure 4A:
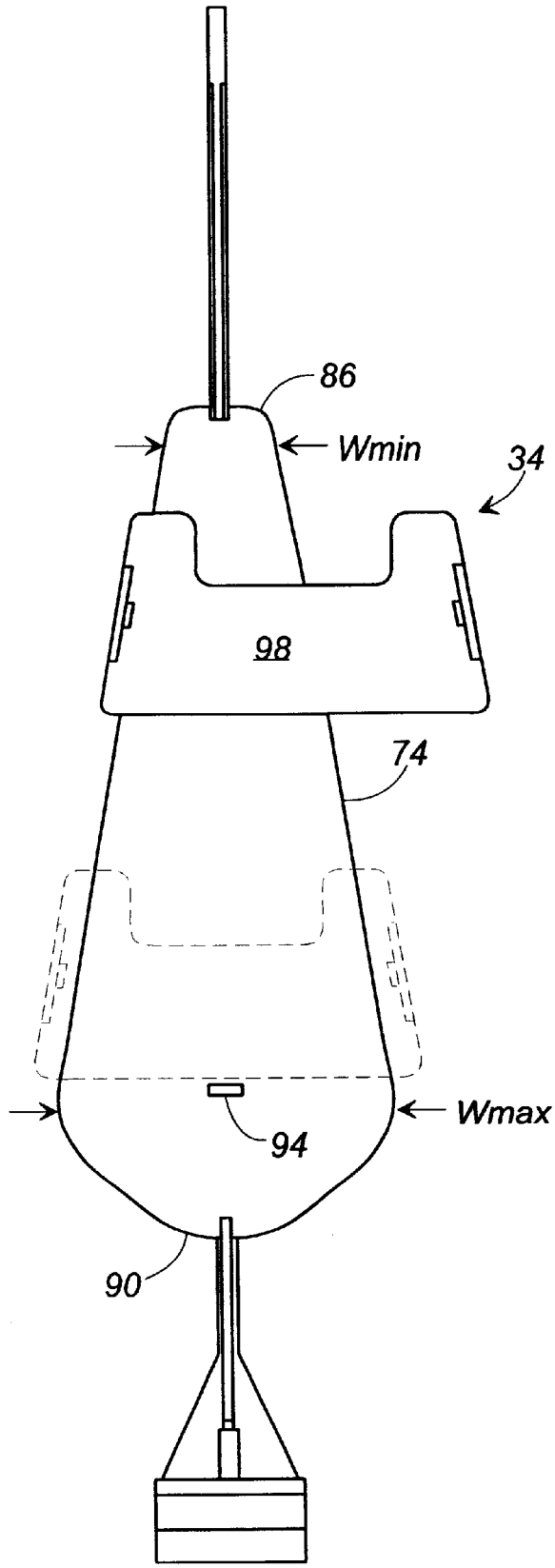
FIGS. 4A and 4B are diagrammatic views illustrating various positionings of a weight assembly useable as part of the bumper assembly of FIG. 1.
Figure 4B:
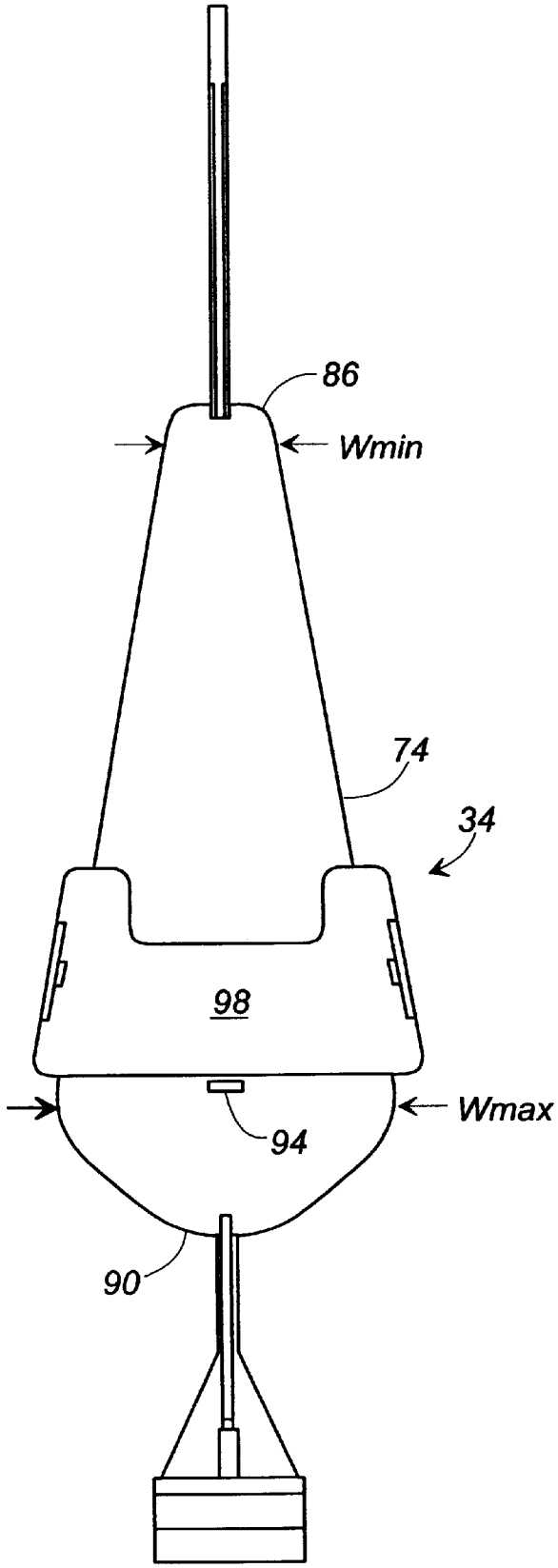

FIGS. 4A and 4B show the contour of an exemplary section 74. In particular, section 74 has minimum width $W_{min}$ at or near its top 86. By contrast, maximum width $W_{max}$ exists for section 74 at or near its bottom 90. Section 74 further includes stop 94, which protrudes from and typically is integrally formed with surface 78. A second stop may be formed with surface 82 if appropriate or desired.

Figure 5:
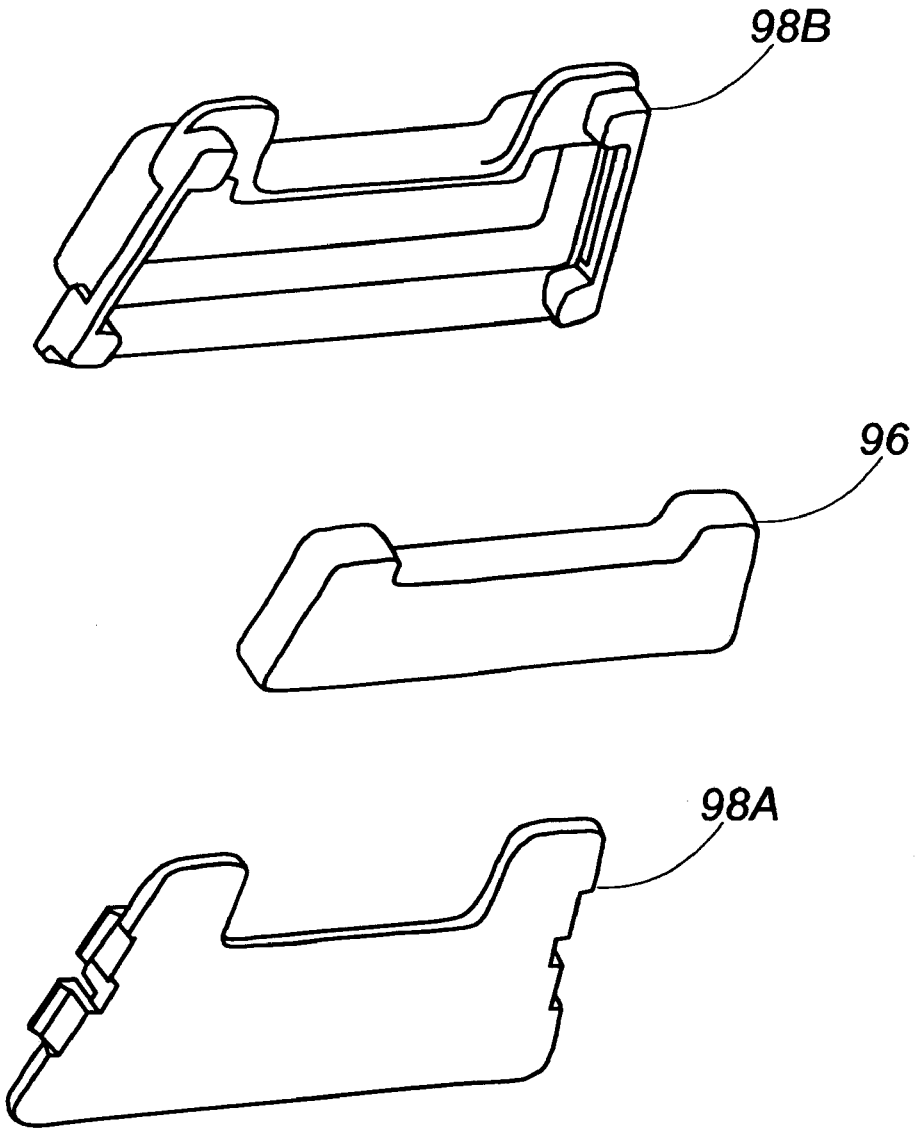
FIG. 5 is an exploded perspective view of the weight assembly of FIG. 4.

FIGS. 4A and 4B, as well as FIG. 5, detail weight assembly 34 of the present invention. In preferred embodiments of the invention, weight assembly 34 comprises both a weight 96 and a housing 98 (which may comprise at least connectable components 98A and 98B) in which weight 96 is placed. In these embodiments, housing 98 is designed so as not to permit weight 96 to move therein but rather to secure it in place.

During manufacture of bumper assembly 10, housing 98 of these embodiments may be fitted about section 74. If necessary for replacement or repair, housing 98 may be made to be removable from section 74. Otherwise, housing 98 is intended to remain surrounding section 74 throughout operation of pool cleaner S.

As shown in FIG. 4B, the internal width of housing 98 is approximately equal to $W_{max}$. As a consequence, when housing 98 approaches bottom 90 of section 74, it cannot move significantly laterally across the section 74. By contrast, the internal width of housing 98 is substantially larger than $W_{min}$. Accordingly, as housing 98 approaches top 86 of section 74, its lateral movement is relatively uncircumscribed (as shown in FIG. 4A). To prevent housing 98 from lodging (jamming) near bottom 90 of section 74, stop 94 may be employed.

When cleaner S traverses the bottom of a pool with body 14 upright, weight assembly 34 is typically stationary, positioned near bottom 90 abutting stop 94. As cleaner S successfully climbs to the top of the side wall of a pool, its natural tendency is to turn and move horizontally along the side wall rather than return to the pool floor. However, as cleaner S begins to become oriented horizontally, weight assembly 34 commences movement (sliding) along section 74 from bottom 90 toward top 86. Movement of weight assembly 34 changes the balance of cleaner S by increasing the moment around an axis perpendicular to the side wall of the pool, causing cleaner S to dive back down to the bottom of the pool. When cleaner S reaches the pool bottom and body 14 is again upright, weight assembly 34 returns to its nominal resting position abutting stop 94, and cleaner S continues traversing the bottom of the pool. In many cases, the action of weight assembly 34 enhances the rate of pool coverage cleaner S can provide.

Side wings 38, when present, help reduce wear of body 14 occurring because of frictional contact of the body 14 with walls of and obstacles within a swimming pool. FIG. 1 illustrates two such wings 38 oriented substantially horizontally (in contrast to bumper 30), each having an end 102 received by collar 54. Ends 102 are fitted or otherwise adapted so as to be retained within collar 54 as cleaner S operates, with wings 38 thereby shielding body 14 from certain contacts. Opposite ends 106 of wings 38 are typically connected to body 14 in any suitable manner. Like bumper 30, wings 38 may have flexible leading edges 110 to promote deflection of cleaner S when obstacles—particularly steps and ladders—are encountered. Any cleaner S with which the present invention is utilized is thus capable not only of enhanced performance in diving to the bottom of a pool, but also of having increased useful life because of decreased wear.

Figure 6:
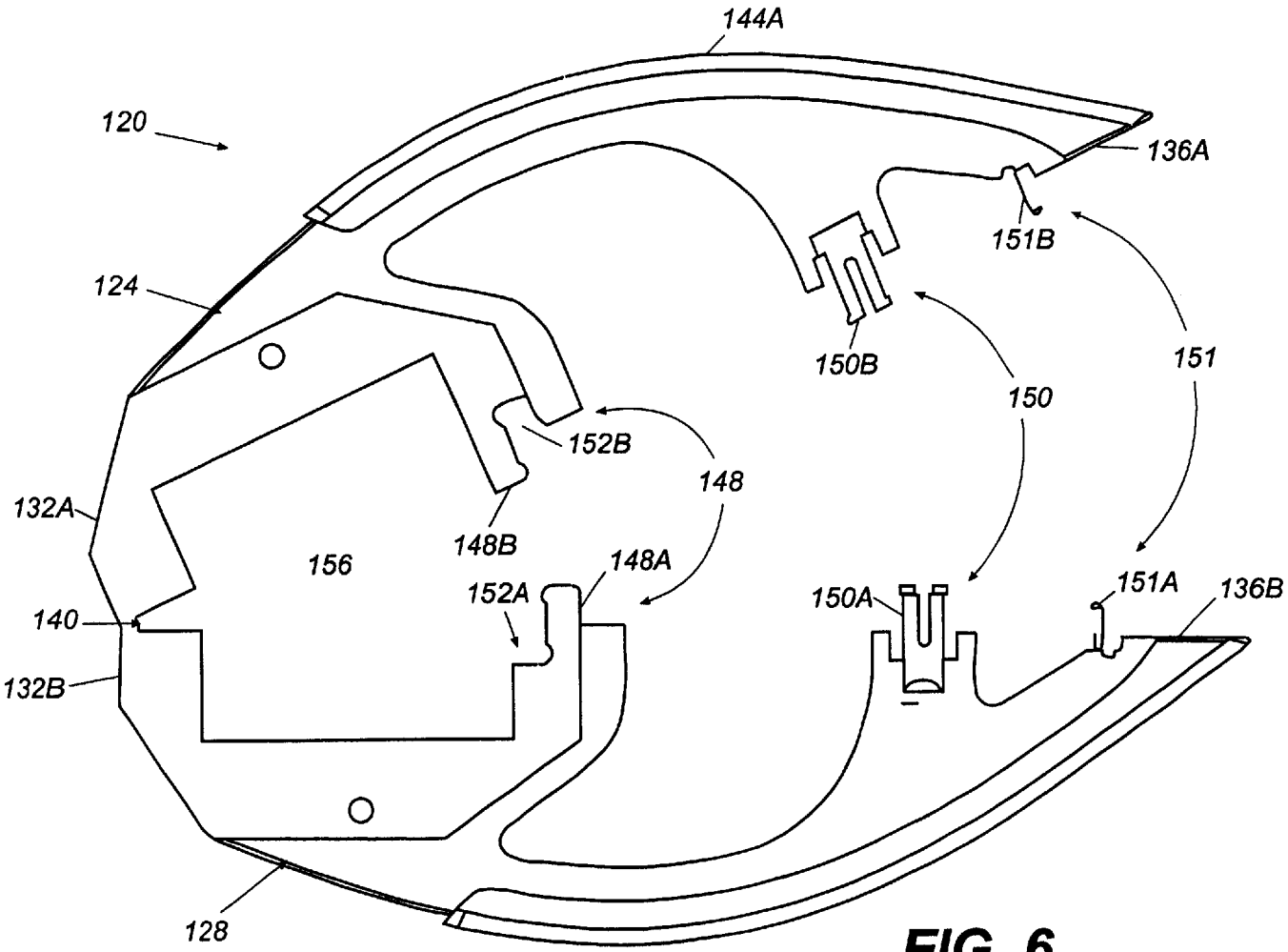
FIG. 6 is a top view of a lower bumper useful as part of the present invention.
Figure 7:
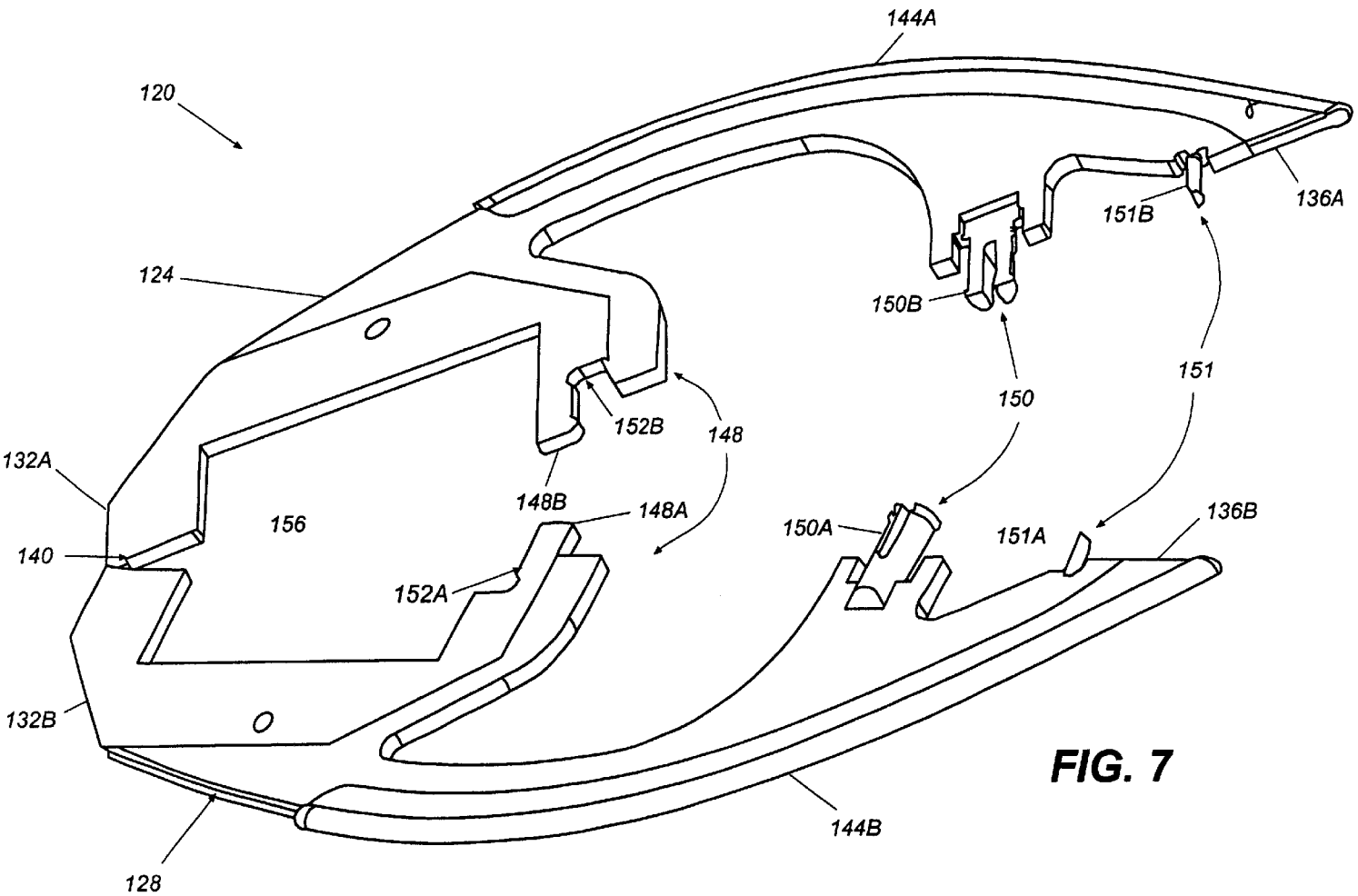
FIG. 7 is a perspective view of the lower bumper of FIG. 6.

FIGS. 6 and 7 illustrate lower bumper 120 of the present invention. Bumper 120 may include frames or sections 124 and 128, each having a first end 132A and 132B, respectively, and a second end 136A and 136B. In the bumper 120 of FIGS. 6 and 7, first ends 132A and 132B are shown as being integrally forted, with an area 140 of reduced width between them. Those skilled in the art will recognize that first ends 132A and 132B need not be integral, but instead may be connected in any appropriate manner. If present, area 140 of reduced width may function as a hinge, permitting second ends 136A and 136B to open to facilitate attaching bumper 120 to a swimming pool cleaner S (as in FIG. 8).

As with bumper 30 and wings 38, sections 124 and 128 of bumper 120 may have flexible leading edges 144A and 144B. Leading edges 144A and 144B preferably are made of polyurethane, although any suitable thermoplastic elastomer or rubber (or other flexible material) may be used instead. They too promote deflection of cleaner S when they contact objects, such as steps, within a pool.

Detailed in FIGS. 6 and 7 are connector sets 148, 150, and 151. Set 148 comprises protrusions 148A and 148B and complementary recesses 152B and 152A. Closing second ends 136A and 136B causes protrusion 148A and recess 152B and protrusion 148B and 152A to engage, enclosing a rectangular space 156. In use, bumper 120 is fitted about footpad 22 or a portion of body 14 abutting the footpad 22 or adjacent thereto, with the footpad 22 or body 14 filling part or all of space 156. Those skilled in the art will understand that space 156 need not necessarily be rectangular, but rather may have any appropriate or suitable shape. Likewise, bumper 120 need not necessarily connect with footpad 22 or body 14; instead, it may attach to or be formed as part of other components of cleaner S as desired. Preferably, however, space 156 indeed is rectangular, and connector set 148 latches underneath a flange of body 14 above footpad 22.

Figure 8:
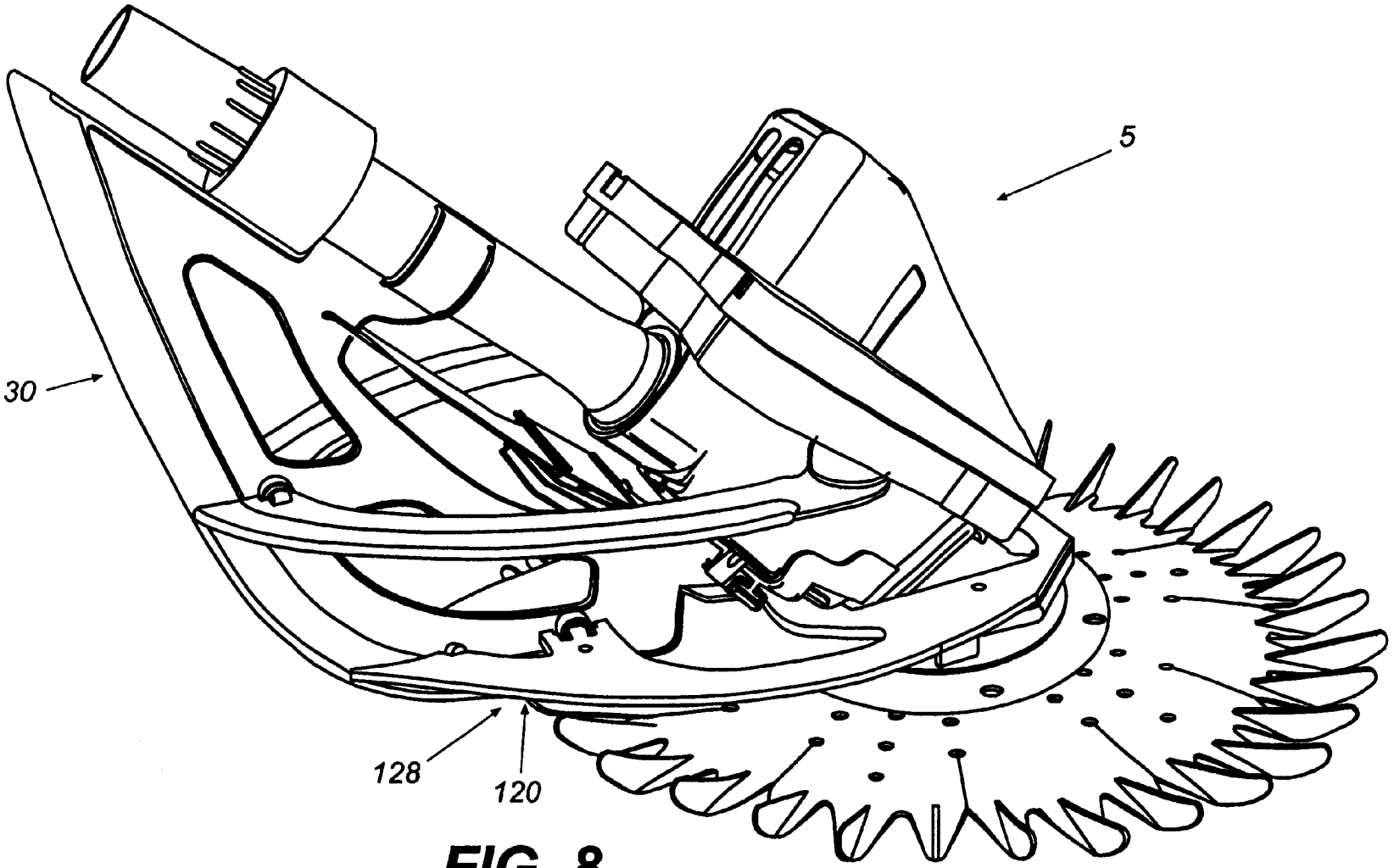
FIG. 8 is a perspective view of a swimming pool cleaner showing exemplary relative locations of the bumper, side wings, and lower bumper of FIGS. 1 and 6.

Connector sets 150 and 151 are designed to connect bumper 120 to frame 42 of bumper 30. FIG. 8 illustrates possible positionings of bumper 120, frame 42, and side wings 38 relative to each other and body 14 of automatic swimming pool cleaner S. As shown in FIG. 8, bumper 30 may be contoured differently than appears in FIG. 1 in order suitably to receive bumper 120.

Connector set 150 may comprise protrusions 150A and 150B, each adapted to be received by and engage a boss such as (or similar to) collar 54. However, because the mechanism for connecting bumpers 120 and 30 is not critical to the invention, bosses or collars need not necessarily be present (and thus are not shown in FIG. 8), and set 150 may be configured other than as protrusions 150A and 150B. Connector set 151 likewise comprises protrusions 151A and 151B designed to be received by a boss, collar, or opening of some sort. Protrusions 151A and 151B may be similar to protrusions 150A and 150B, although preferably they have smaller diameter and are oriented ninety degrees from the orientation of protrusions 150A and 150B. Again, however, set 151 need not be configured as shown in FIG. 8, and other methods of connecting bumpers 30 and 120, if such is desired, may be utilized.

In use, bumper 120 extends beyond the periphery of disc 26. In some planes and paths of travel, therefore, second ends 136A and 136B or edges 144A or 144B of bumper 120 form the leading edge of pool cleaner S. Should a cleaner S approach an underwater object along such a path, bumper 120 will produce the initial contact with the object, deflecting the cleaner S along a new path and thereby reduce the possibility of its becoming stuck against the object. Flexible edges 144A and 144B facilitate this deflection, providing sacrificial, high-wearability bearing surfaces with substantial curvature. Alternatively, however, edges 144A and 144B may be partially or wholly rigid or be angled or inclined rather than curved.

The foregoing is provided for purposes of illustrating, explaining, and describing embodiments of the present invention. Modifications and adaptations to these embodiments will be apparent to those skilled in the art and may be made without departing from the scope or spirit of the invention.

What is claimed is:

1. A bumper assembly for a swimming pool cleaner, such assembly having a leading edge and comprising:

a. a substantially rigid frame;

b. means, comprising a flexible section forming the leading edge and which is connected to the substantially rigid frame, for facilitating the swimming pool cleaner deflecting off obstacles in use;

c. means for connecting the substantially rigid frame to the swimming pool cleaner so that the substantially rigid frame is oriented generally horizontally when the swimming pool cleaner is upright;

d. a bumper connected to the swimming pool cleaner so as to be oriented generally vertically when the swimming pool cleaner is upright;

e. means for connecting the substantially rigid frame to the bumper;

f. at least one side wing;

g. means for connecting the at least one side wing to the swimming pool cleaner so that the at least one side wing is oriented generally horizontally and above the substantially rigid frame when the swimming pool cleaner is upright; and h. means for connecting the at least one side wing to the bumper.

2. A bumper assembly according to claim 1 in which the means for connecting the substantially rigid frame to the swimming pool cleaner comprises a first connector set including a protrusion and a complementary recess.

3. A bumper assembly according to claim 2 in which the means for connecting the substantially rigid frame to the swimming pool cleaner further comprises a second connector set including a protrusion and a complementary recess.

4. A bumper assembly according to claim 1 further comprising a second flexible section connected to the substantially rigid frame.

5. A bumper assembly according to claim 4 in which the substantially rigid frame comprises a plurality of sections, each section connected to one of the flexible section or the second flexible section.

6. A bumper assembly according to claim 1 in which the flexible section is made of polyurethane.

7. A bumper assembly according to claim 1 in which the substantially rigid frame comprises an area of reduced width to form a hinge.

8. A bumper assembly for a swimming pool cleaner adapted to clean a surface of a swimming pool, such assembly comprising:

a. a first bumper having a leading edge and comprising:
   i. a substantially rigid frame;
   ii. means, comprising a flexible section forming the leading edge and which is connected to the substantially rigid frame, for facilitating the swimming pool cleaner deflecting off obstacles in use; and
   iii. means, comprising a first protrusion and a complementary recess, for connecting the frame to the swimming pool cleaner so that the frame is oriented generally horizontally when the swimming pool cleaner is upright;

b. a second bumper adapted for connection to the swimming pool cleaner so as to be oriented generally vertically when the swimming pool cleaner is upright;

c. means, comprising a second protrusion and a complementary recess, for connecting the substantially rigid frame to the second bumper; and d. at least one side wing adapted for connection to the swimming pool cleaner so as during normal use to be farther from the surface to be cleaned than is the first bumper.

9. A swimming pool cleaner comprising:

a. a body;

b. a flexible disc;

c. an elongated first bumper connected to the body so as to be oriented generally vertically when the body is upright;

d. a second bumper having a leading edge and connected to the body so as to be oriented generally horizontally proximate the flexible disc when the body is upright, the second bumper comprising a substantially rigid frame to which a flexible section is connected to form its leading edge; and e. at least one side wing connected to the body so as to be oriented generally horizontally and above the second bumper when the body is upright.

* * * * *

UNITED STATES PATENT AND TRADEMARK OFFICE

CERTIFICATE OF CORRECTION

PATENT NO. : 6,226,826 B1
DATED : May 8, 2001
INVENTOR(S) : Chris A. Rice et al.

It is certified that error appears in the above-identified patent and that said Letters Patent is hereby corrected as shown below:

Column 1,
Line 62, delete the semicolon and substitute a comma therefor

Column 5,
Line 28, delete "forted" and substitute -- formed -- therefor

Signed and Sealed this

Nineteenth Day of March, 2002

*Attest:*

*Attesting Officer*

JAMES E. ROGAN
*Director of the United States Patent and Trademark Office*